US005683314A

United States Patent [19]

Musso

[11] Patent Number: 5,683,314

[45] Date of Patent: Nov. 4, 1997

[54] WATER ACTIVATED HOPSCOTCH GAME

[76] Inventor: Anthony J. Musso, 300 Norwood Ave., Bessemer, Ala. 35020

[21] Appl. No.: 783,248

[22] Filed: Jan. 14, 1997

[51] Int. Cl.[6] ..... A63B 67/00

[52] U.S. Cl. ..... 473/414

[58] Field of Search ..... 473/414

[56] References Cited

U.S. PATENT DOCUMENTS

| | | | |
|---|---|---|---|
| Re. 25,474 | 11/1963 | O'Rear | 473/414 |
| 3,091,454 | 5/1963 | Sam | 473/414 |
| 3,139,281 | 6/1964 | Nicholson | 473/414 |
| 3,515,385 | 6/1970 | Gunderson | 473/414 |
| 4,185,819 | 1/1980 | Hardley | 473/414 |
| 4,733,864 | 3/1988 | Casteel | 473/414 |
| 4,982,959 | 1/1991 | Rudell et al. | 273/448 X |
| 5,318,307 | 6/1994 | Bouchard et al. | 273/348.4 |

*Primary Examiner*—William H. Grieb

*Attorney, Agent, or Firm*—Wm. Randall May

[57] ABSTRACT

A water play version of the game of hopscotch is disclosed. A grid of multiple game blocks is provided with each block having one or more small showerhead-type spray nozzles connected by conduit to a water supply. Each spray nozzle is controlled by a pressure-sensitive valve by which water sprays through the nozzle whenever a participant steps or hops onto that particular block. The blocks may be arranged in different patterns to play other games and the spray nozzles may be controlled remotely to allow for surprise or random spraying during gameplay.

9 Claims, 4 Drawing Sheets

WATER ACTIVATED HOPSCOTCH GAME

BACKGROUND OF THE INVENTION

This invention relates generally to outdoor amusement devices and more particularly to a water play version of the game of hopscotch.

As is well known, the game of hopscotch is a child's game in which a player tosses a small stone or other similar object into one section after another of a grid usually drawn or marked on the ground, pavement or other flat surface. Once the stone is tossed by the player into a particular grid section, the player then hops from grid section to grid section to pick up the stone after each toss.

Prior art enhancements to the game of hopscotch have included such things as inflatable grids and flexible carpet grids as disclosed in U.S. Pat. Nos. 4,185,819 and 4,733,864 to Hartley and Casteel, respectively.

The present invention is directed to a water play version of this old game wherein a player is sprayed, automatically or randomly, as the player hops through the grid sections of the game.

SUMMARY OF THE INVENTION

In view of the foregoing, it is a primary object of this invention to provide method and apparatus for a water play version of the game of hopscotch.

According to an embodiment of the invention, a water play version of the game of hopscotch comprises a grid of multiple, interconnected game blocks wherein each block includes one or more small showerhead-type outlets connected by conduit to a control means and to a water supply.

An objective of the present invention is to provide apparatus for a water play version of the game of hopscotch wherein a player, through the act of hopping onto a grid square, activates one or more spray nozzles which sprays the player with water as the player hops through the game grid.

Another objective of the present invention is to provide pressure sensitive means, located within interconnected grid squares, for activating spray nozzles for spraying a player with water as the player hops through the hopscotch grid.

A further objective of the present invention is to provide apparatus for a water play version of the game of hopscotch wherein a player can be randomly sprayed with water, or receive a "surprise spraying", by remotely controlled spray nozzles located within the game grid squares.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
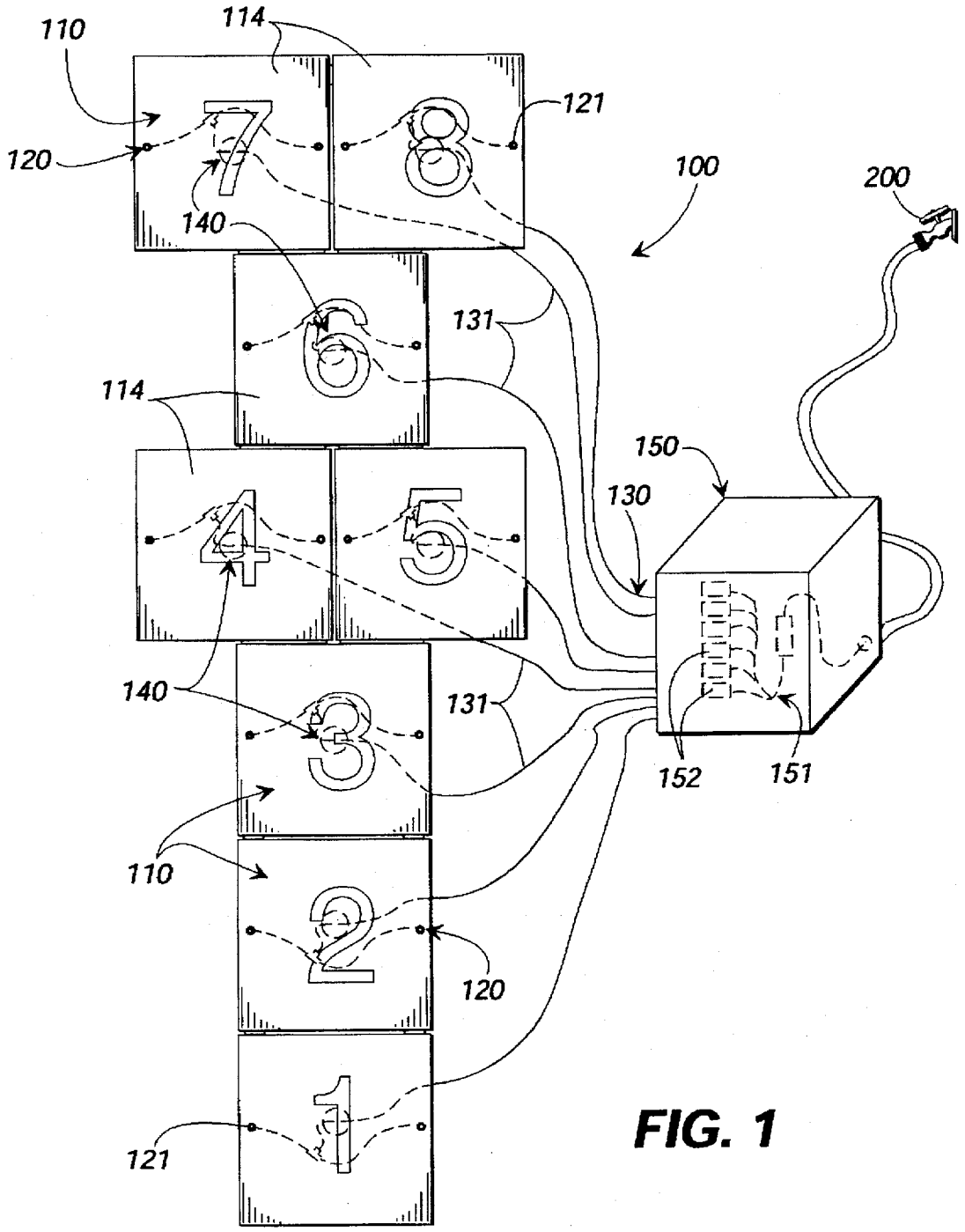
FIG. 1 is a perspective view of an embodiment of the invention.

In accordance with an embodiment of the invention, FIG. 1 shows a water play version of the game of hopscotch 100 comprising a plurality of interconnected grid squares 110; multiple spray means 120 attached to said grid squares 110; conduit means 130 for supplying water to said spray means 120; a plurality of valve means 140 for controlling the flow of water to said spray means 120; and a control means 150 for directing and controlling the flow of water from a source 200 to said conduit means 130.

Figure 2:
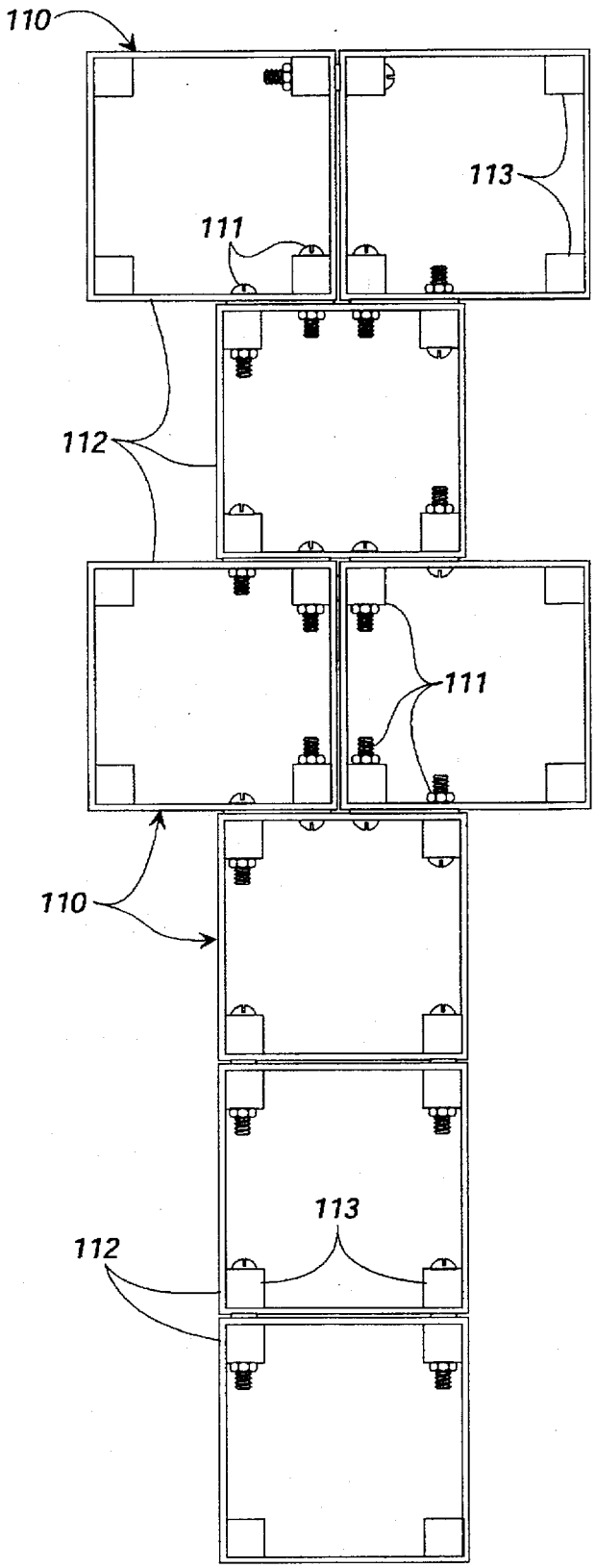
FIG. 2 is a plan view of the grid squares of the embodiment of FIG. 1.
Figure 4:
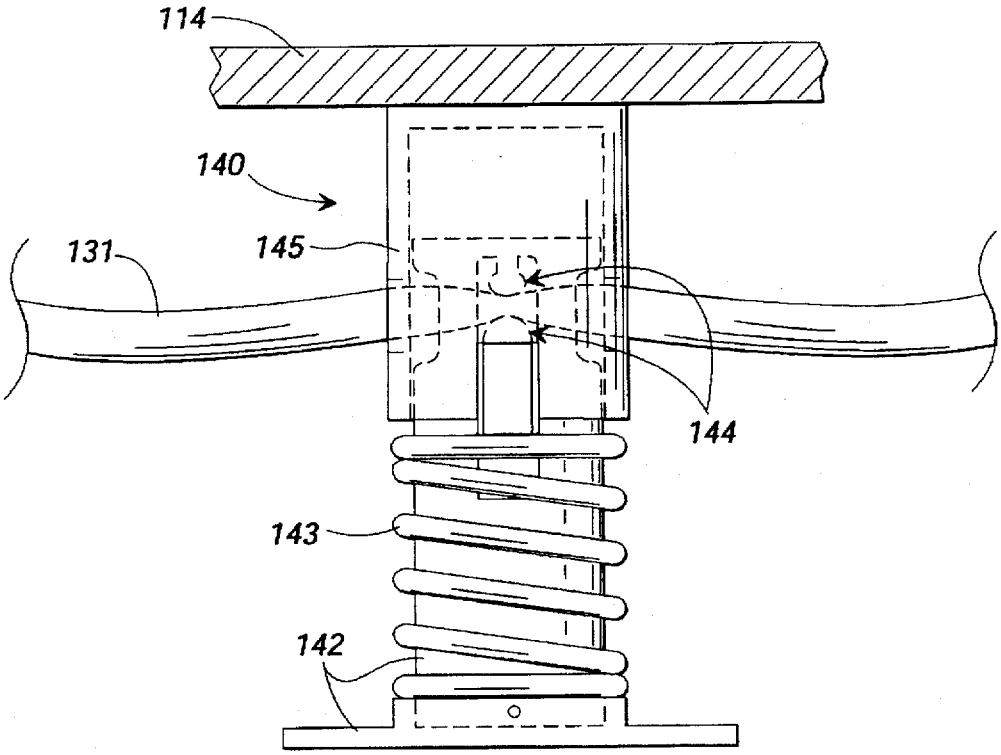
FIG. 4 is a front view of the pinch valve of FIG. 3.
Figure 3:
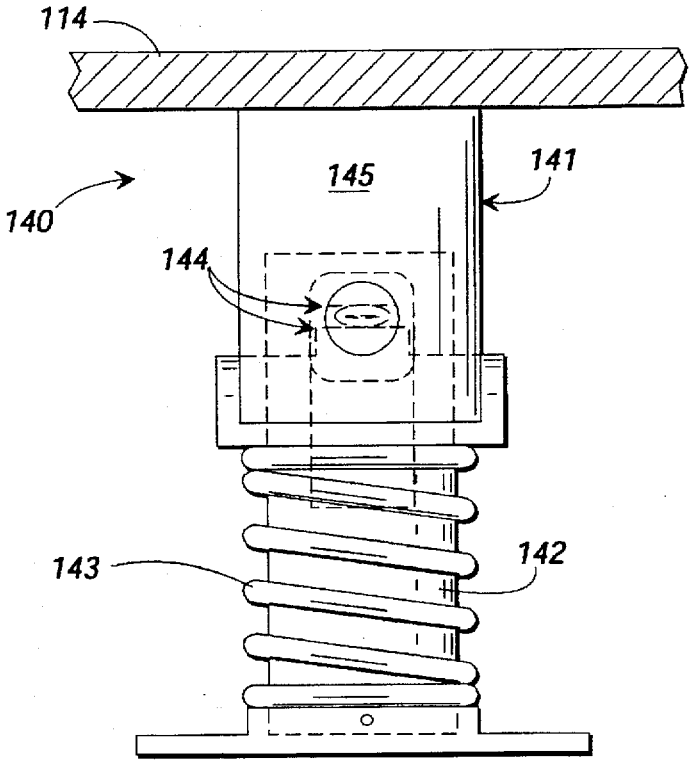
FIG. 3 is a side view of a pinch valve used in the embodiment of FIG. 1 to activate spray nozzles during game play.
Figure 5:
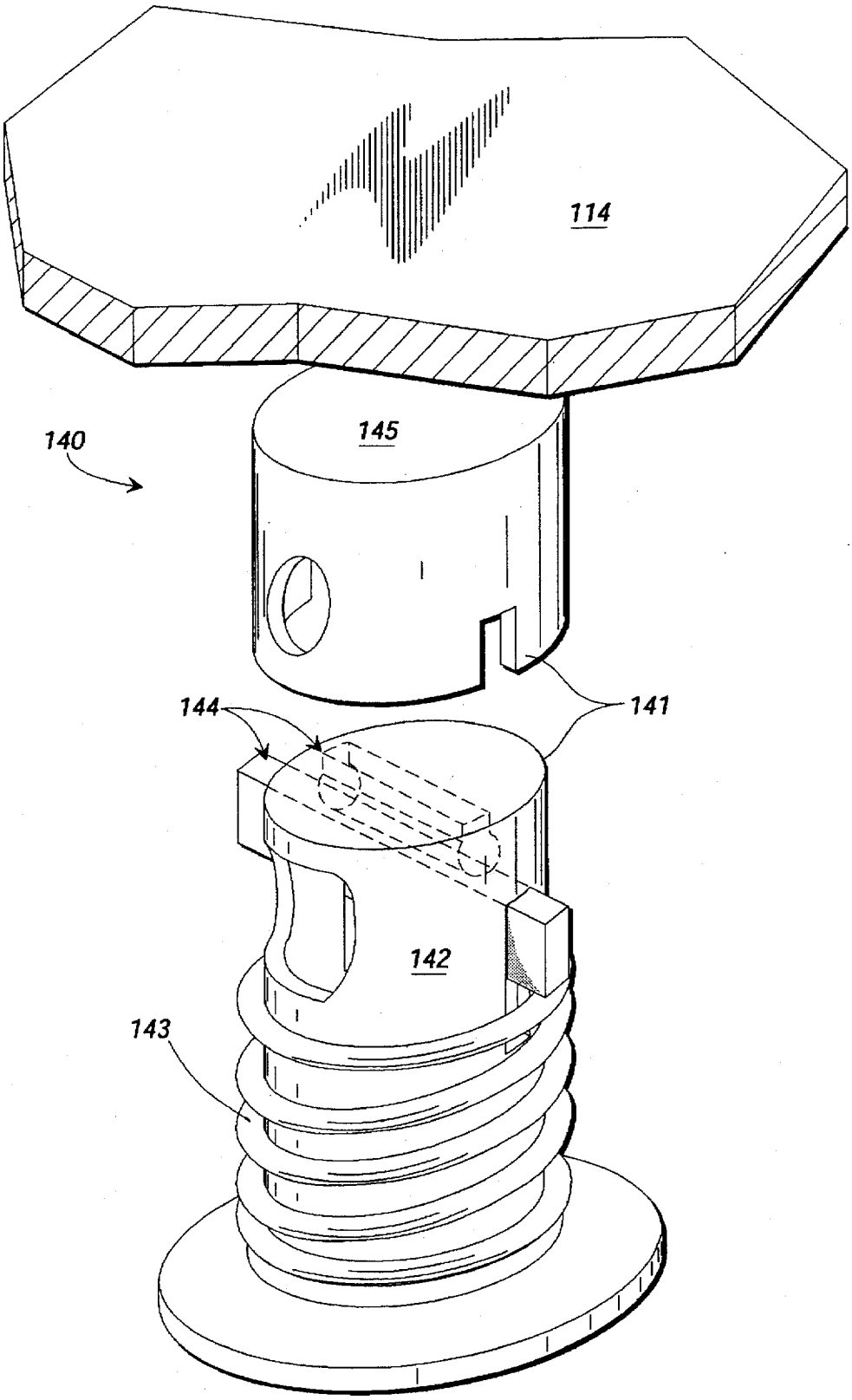
FIG. 5 is an exploded, perspective view of the pinch valve of FIGS. 3 & 4.

As shown in FIG. 2, the grid squares 110 may be interconnected and arranged in any manner desired by the game players. In this embodiment the grid squares 110 are interconnected by a plurality of bolt means 111 and are arranged into a typical hopscotch game grid. It should be noted that the grid squares 110 may be arranged into different patterns for playing games other than the game of hopscotch, such as the game of "four-square". Each grid square 110 of this embodiment comprises a rigid grid frame 112; four (4) corner supports 113; and a semi-rigid, numbered, grid square platform 114 partially supported by said corner supports 113. Each grid square 110 is provided with spray means 120 comprising one or more showerhead-type spray nozzles 121 located on the perimeter of the grid platform 114 of said grid square 110. The spray nozzles 121 of each grid square 110 are flowably connected to said conduit means 130 and are controlled by said valve means 140. Said valve means 140 comprises a pinch-type release valve 141 as shown in FIGS. 3, 4 & 5. Each pinch valve 141 controls the flow of water through said conduit means 130 to the spray nozzle(s) 121 of each grid square 110. As best seen in FIG. 5, each pinch valve 141 operates from a normally closed position and comprises a valve stand 142, a valve spring 143, a pinch bar assembly 144 and a valve cap 145 slidably positioned on said valve stand 142 as shown. Downward pressure applied to the valve cap 145 causes the pinch bar assembly 144 to open thus allowing water to pass through the tubing member 131 and on to one or more spray nozzles 121 as best seen in FIGS. 3 & 4. The pinch valve 141 is attached to, and is centrally positioned beneath, the grid platform 114 of each said grid square 110 so that flexing of the grid platform 114 causes said valve 141 to open and close. The conduit means 130 comprises a plurality of flexible tubing members 131 which flowably connect the spray nozzles 121 of each grid square 110 through the square's valve means 140 to the control means 150. The control means 150 comprises a manifold means 151 connected to said water source 200 for directing the flow of water from said source 200 to the plurality of flexible tubing members 131 supplying the spray nozzles 121 of said grid squares 110. As an optional game variation, the control means 150 may further comprise multiple control valves 152 for remote and random control of the flow of water through each of the flexible tubing members 131 supplying the spray nozzles 121 of each grid square 110.

The grid platform 114 of each grid square 110 is sufficiently flexible, and the valve means 140 attached thereto sufficiently sensitive, so that the weight and force of a child hopping or stepping onto said platform 114 is enough to cause said valve 140 to open and to allow water to reach the spray nozzle(s) 121 of said grid square 110 thereby spraying the child with water.

The optional remote control valves 152 would allow an operator to randomly choose grid squares 110 in which to activate thereby providing for "surprise spraying" of a player as the player advances along the game grid 100.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. A water play version of the game of hopscotch comprising:

a plurality of interconnected grid squares having a frame and a platform means;

spray means attached to said platform means of said grid squares;

conduit means flowably attached to said spray means for supplying liquid to said spray means;

valve means attached to said platform means of said grid squares for controlling the flow of liquid to said spray means; and, a control means for directing and controlling the flow of liquid from a source to said conduit means.

2. The apparatus of claim 1, wherein said frame of said grid square is rigid and wherein said grid square further comprises a support means attached to said frame for supporting said platform means.

3. The apparatus of claim 1, wherein said platform means is semi-rigid.

4. The apparatus of claim 1, wherein said spray means comprise one or more spray nozzles.

5. The apparatus of claim 1, wherein said spray means are positioned along the perimeter of said platform means.

6. The apparatus of claim 1, wherein said conduit means comprises a plurality of flexible tubing members which flowably connect said spray means, through said valve means, to said control means.

7. The apparatus of claim 1, wherein said valve means comprises a normally closed, spring-operated, pinch-type release valve which is attached to one side of said platform means and centrally positioned within said frame of said grid square.

8. The apparatus of claim 1, wherein said control means comprises a manifold means for flowably connecting said conduit means to said liquid source.

9. The apparatus of claim 1, wherein said control means further comprises a plurality of control valves for remote and random control of the flow of liquid to said conduit means.

* * * * *